US011814943B2

(12) United States Patent
Wicks et al.

(10) Patent No.: US 11,814,943 B2
(45) Date of Patent: Nov. 14, 2023

(54) SLIDE DRILLING CONTROL BASED ON TOP DRIVE TORQUE AND ROTATIONAL DISTANCE

(71) Applicant: Schlumberger Technology Corporation, Sugar Land, TX (US)

(72) Inventors: Nathaniel Wicks, Somerville, MA (US); Ginger Hildebrand, Houston, TX (US)

(73) Assignee: Schlumberger Technoloyg Corporation, Sugar Land, TX (US)

( * ) Notice: Subject to any disclaimer, the term of this patent is extended or adjusted under 35 U.S.C. 154(b) by 125 days.

(21) Appl. No.: 17/112,639

(22) Filed: Dec. 4, 2020

(65) Prior Publication Data

US 2022/0178241 A1 Jun. 9, 2022

(51) Int. Cl.
*E21B 44/04* (2006.01)
*E21B 3/02* (2006.01)

(52) U.S. Cl.
CPC ..... *E21B 44/04* (2013.01); *E21B 3/022* (2020.05)

(58) Field of Classification Search
CPC ..... E21B 44/02; E21B 44/04; E21B 3/022
See application file for complete search history.

(56) References Cited

U.S. PATENT DOCUMENTS 6,050,348 A 4/2000 Richarson et al.
6,338,390 B1 1/2002 Tibbitts
6,918,453 B2 7/2005 Haci et al.
7,096,979 B2 8/2006 Haci et al.
7,152,696 B2 12/2006 Jones
7,404,454 B2 7/2008 Hulick
7,461,705 B2 12/2008 Hulick et al.
7,588,100 B2 9/2009 Hamilton
7,802,634 B2 9/2010 Boone
7,810,584 B2 10/2010 Haci et al.
7,823,655 B2 11/2010 Boone et al.
8,360,171 B2 1/2013 Boone et al.
8,387,720 B1 3/2013 Keast et al.
8,528,663 B2 9/2013 Boone
8,602,126 B2 12/2013 Boone et al.
8,672,055 B2 3/2014 Boone et al.
RE44,956 E 6/2014 Richardson et al.
RE44,973 E 7/2014 Richardson et al.
8,939,233 B2 1/2015 Edbury et al.
(Continued)

*Primary Examiner* — Christopher J Sebesta
(74) *Attorney, Agent, or Firm* — Jeffrey D. Frantz

(57) ABSTRACT

Apparatus and methods for controlling slide drilling based on torque and rotational distance of a top drive connected with an upper end of a drill string. A method may comprise operating a processing device that receives torque measurements indicative of torque output by the top drive, receives rotational distance measurements indicative of rotational distance imparted by the top drive, causes the top drive to rotate the drill string while the drill string is off-bottom, determines a reference torque based on the torque measurements received while the drill string is rotated off-bottom, causes the top drive to alternatingly rotate the drill string based on the reference torque to perform slide drilling, determines a reference rotational distance based on the rotational distance measurements received during the slide drilling, and causes the top drive to alternatingly rotate the drill string based on the reference rotational distance to perform the slide drilling.

22 Claims, 4 Drawing Sheets

(56) References Cited

U.S. PATENT DOCUMENTS

| | | | | |
|---|---|---|---|---|
| 8,939,234 | B2 | 1/2015 | Mebane, III et al. | |
| 9,145,768 | B2 | 9/2015 | Normore et al. | |
| 9,249,655 | B1 | 2/2016 | Keast et al. | |
| 9,290,995 | B2 | 3/2016 | Boone et al. | |
| 9,309,760 | B2 | 4/2016 | Haci et al. | |
| 9,359,881 | B2 | 6/2016 | DiSantis | |
| 9,404,307 | B2 * | 8/2016 | Maidla | E21B 7/068 |
| 9,506,336 | B2 | 11/2016 | Orbell | |
| 9,593,567 | B2 | 3/2017 | Pink et al. | |
| 9,650,880 | B2 | 5/2017 | Bowley et al. | |
| 10,054,917 | B2 | 8/2018 | Penn et al. | |
| 10,612,367 | B2 | 4/2020 | Drban et al. | |
| 10,829,994 | B2 | 11/2020 | Penn et al. | |
| 2013/0032407 | A1 | 2/2013 | Edbury et al. | |
| 2016/0168973 | A1 | 6/2016 | Dykstra et al. | |
| 2016/0237802 | A1 * | 8/2016 | Boone | E21B 44/00 |
| 2016/0245067 | A1 | 8/2016 | Haci et al. | |
| 2018/0320501 | A1 * | 11/2018 | Jeffryes | E21B 44/04 |
| 2019/0218901 | A1 | 7/2019 | Groover et al. | |
| 2019/0353024 | A1 * | 11/2019 | Papouras | E21B 47/008 |
| 2020/0165913 | A1 | 5/2020 | Benson et al. | |
| 2020/0378237 | A1 | 12/2020 | Wicks et al. | |

* cited by examiner

SLIDE DRILLING CONTROL BASED ON TOP DRIVE TORQUE AND ROTATIONAL DISTANCE

BACKGROUND OF THE DISCLOSURE

Wells are drilled into the ground or ocean bed to recover natural deposits of oil, gas, and other materials that are trapped in subterranean formations. Drilling operations may be performed at a wellsite by a well construction system (i.e., a drilling rig) having various surface and subterranean well construction equipment being operated in a coordinated manner. For example, a surface driver (e.g., a top drive and/or a rotary table) and/or a downhole mud motor can be utilized to rotate and advance a drill string into a subterranean formation to drill a wellbore. The drill string may include a plurality of drill pipes coupled together and terminating with a drill bit. Length of the drill string may be increased by adding additional drill pipes while depth of the wellbore increases. Drilling fluid may be pumped from the wellsite surface down through the drill string to the drill bit. The drilling fluid lubricates and cools the drill bit and carries drill cuttings from the wellbore back to the wellsite surface. The drilling fluid returning to the surface may then be cleaned and again pumped through the drill string. The well construction equipment may be monitored and controlled by corresponding local controllers and/or a remotely located central controller. Some operations of the well construction equipment may also or instead be monitored and controlled manually by a human operator (e.g., a driller) via a control workstation located within a control center.

The wellbore may be drilled via directional drilling by selectively rotating the drill bit via the surface driver and/or the mud motor. Directional drilling performed while the drill bit is oriented in an intended direction by the surface driver and rotated by the mud motor is known in the oil and gas industry as slide drilling. During slide drilling, at least a portion of the drill string slides along a sidewall of the wellbore, thereby reducing the amount of drill string weight that is transferred to the drill bit because of axial friction between the sidewall of the wellbore and the drill string. A reduced weight-on-bit (WOB) causes a reduced axial contact force between the drill bit and the formation being cut by the drill bit, resulting in a reduced rate of penetration (ROP) through the formation.

SUMMARY OF THE DISCLOSURE

This summary is provided to introduce a selection of concepts that are further described below in the detailed description. This summary is not intended to identify indispensable features of the claimed subject matter, nor is it intended for use as an aid in limiting the scope of the claimed subject matter.

The present disclosure introduces an apparatus including a control system for controlling rotation of a top drive that connects with an upper end of a drill string. The control system includes a torque sensor, a rotation sensor, and a processing device. The torque sensor facilitates torque measurements indicative of torque output by the top drive to the upper end of the drill string. The rotation sensor facilitates rotational distance measurements indicative of rotational distance imparted by the top drive to the upper end of the drill string. The processing device includes a processor and a memory storing computer program code. The processing device receives the torque measurements, receives the rotational distance measurements, causes the top drive to rotate the drill string while the drill string is off-bottom, determines a reference torque based on the torque measurements received while the drill string is off-bottom and rotated by the top drive, causes the top drive to alternatingly rotate the drill string in opposing directions based on the reference torque to perform slide drilling operations, determines a reference rotational distance based on the rotational distance measurements received during the slide drilling operations, and causes the top drive to alternatingly rotate the drill string in the opposing directions based on the reference rotational distance to perform the slide drilling operations.

The present disclosure also introduces a method that includes commencing operation of a processing device that controls rotation of a top drive that connects with an upper end of a drill string. The operating processing device receives torque measurements indicative of torque output by the top drive to the upper end of the drill string, receives rotational distance measurements indicative of rotational distance imparted by the top drive to the upper end of the drill string, causes the top drive to rotate the drill string while the drill string is off-bottom, determines a reference torque based on the torque measurements received while the drill string is off-bottom and rotated by the top drive, causes the top drive to alternatingly rotate the drill string in opposing directions based on the reference torque to perform slide drilling operations, determines a reference rotational distance based on the rotational distance measurements received during the slide drilling operations, and causes the top drive to alternatingly rotate the drill string in the opposing directions based on the reference rotational distance to perform the slide drilling operations.

The present disclosure also introduces a method that includes commencing operation of a processing device to control rotation of a top drive connected with an upper end of a drill string. The operating processing device receives torque measurements indicative of torque output by the top drive to the upper end of the drill string, receives rotational distance measurements indicative of rotational distance imparted by the top drive to the upper end of the drill string, causes the top drive to rotate the drill string while the drill string is off-bottom, determines a reference torque based on the torque measurements received while the drill string is off-bottom and rotated by the top drive, causes the top drive to alternatingly rotate the drill string in opposing directions based on the reference torque to perform a calibration stage of slide drilling operations, records the rotational distance measurements during the calibration stage of the slide drilling operations, and determines a reference rotational distance based on the recorded rotational distance measurements. The reference rotational distance is or includes an average rotational distance of the alternating rotations of the drill string caused by the top drive. The operating processing device also causes the top drive to alternatingly rotate the drill string in the opposing directions based on the reference rotational distance to perform a post-calibration stage of the slide drilling operations.

These and additional aspects of the present disclosure are set forth in the description that follows, and/or may be learned by a person having ordinary skill in the art by reading the material herein and/or practicing the principles described herein. At least some aspects of the present disclosure may be achieved via means recited in the attached claims.

BRIEF DESCRIPTION OF THE DRAWINGS

The present disclosure is understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
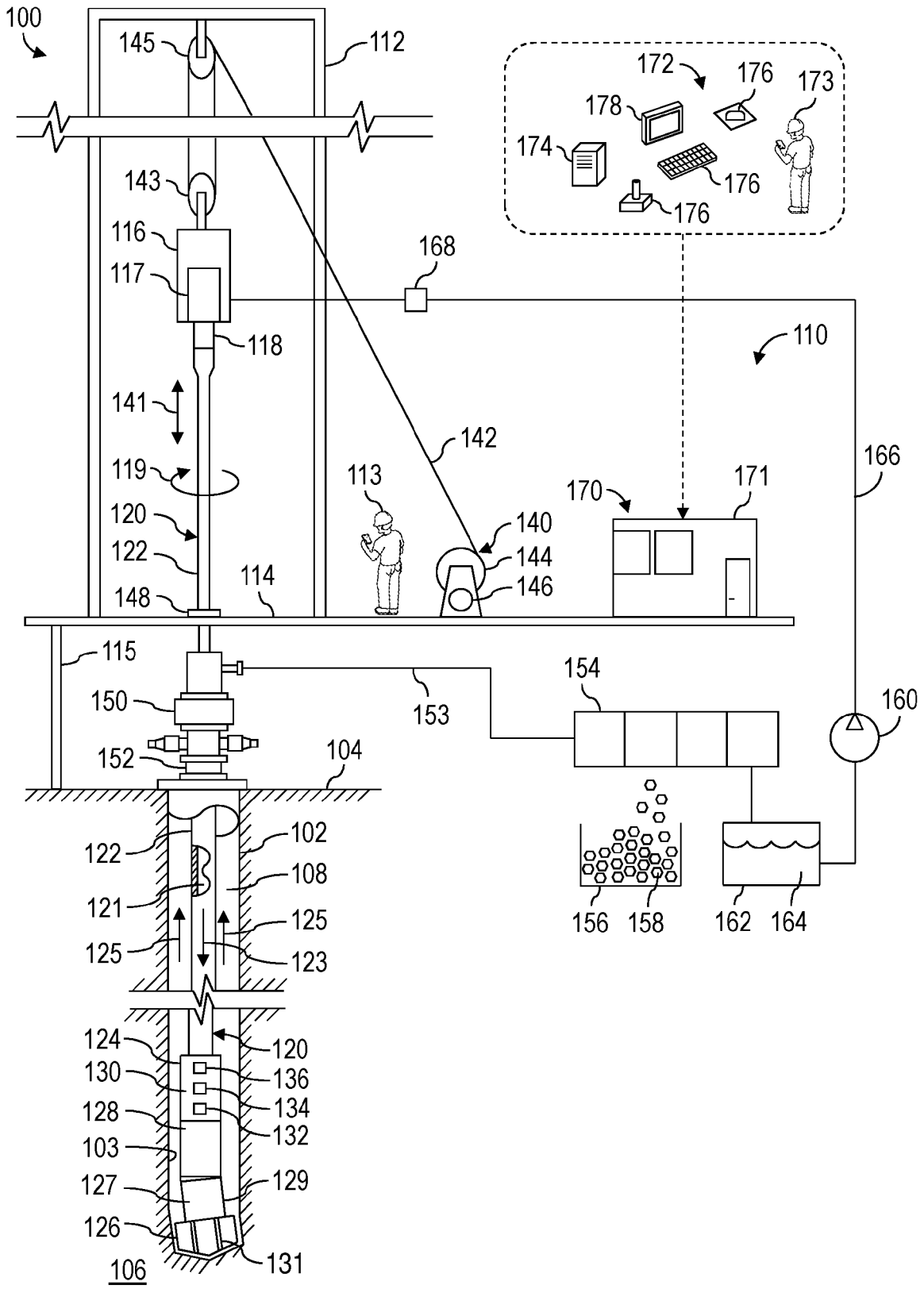
FIG. 1 is a schematic view of at least a portion of an example implementation of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for simplicity and clarity and does not in itself dictate a relationship between the various embodiments and/or configurations discussed.

Systems and methods (e.g., processes, operations) according to one or more aspects of the present disclosure may be used or performed in association with a well construction system at a wellsite, such as for constructing a wellbore to obtain hydrocarbons (e.g., oil and/or gas) or other natural resources from a subterranean formation. A person having ordinary skill in the art will readily understand that one or more aspects of systems and methods disclosed herein may be utilized in other industries and/or in association with other systems.

FIG. 1 is a schematic view of at least a portion of an example implementation of a well construction system 100 according to one or more aspects of the present disclosure. The well construction system 100 represents an example environment in which one or more aspects of the present disclosure described below may be implemented. The well construction system 100 may be or comprise a well construction rig (i.e., a drilling rig) and associated equipment collectively operable to construct (e.g., drill) a wellbore 102 extending from a wellsite surface 104 into a subterranean formation 106 via rotary and/or directional drilling. Although the well construction system 100 is depicted as an onshore implementation, the aspects described below are also applicable or readily adaptable to offshore implementations.

The well construction system 100 comprises well construction equipment, such as surface equipment 110 located at the wellsite surface 104 and a drill string 120 suspended within the wellbore 102. The surface equipment 110 may include a support structure 112 (e.g., a mast or derrick) disposed over a rig floor 114. The drill string 120 may be suspended within the wellbore 102 from the support structure 112. The support structure 112 and the rig floor 114 may be collectively supported over the wellbore 102 by support structures 115 (e.g., legs). Certain pieces of surface equipment 110 may be manually operated (e.g., by hand, via a local control panel, etc.) by rig personnel 113 (e.g., a roughneck or another human rig operator) located at various portions (e.g., rig floor 114) of the well construction system 100.

The drill string 120 may comprise a BHA 124 and means 122 for conveying the BHA 124 within the wellbore 102. The conveyance means 122 may comprise drill pipe, heavy-weight drill pipe (HWDP), wired drill pipe (WDP), tough logging condition (TLC) pipe, and/or other means for conveying the BHA 124 within the wellbore 102. A lower (i.e., downhole) end of the BHA 124 may include or be coupled to a drill bit 126. Rotation of the drill bit 126 and the weight of the drill string 120 may collectively operate to form the wellbore 102. The drill string 120, including the drill bit 126, may be rotated 119 by a top drive 116 connected with the drill string 120. The top drive 116 may comprise a drive shaft 118 operatively connected with an electric motor 117. The drive shaft 118 may be selectively coupled with an upper end of the drill string 120 and the motor 117 may be selectively operated to rotate 119 the drive shaft 118, and thus the drill string 120 coupled with the drive shaft 118.

The BHA 124 may comprise a downhole mud motor 128 operatively connected with the drill bit 126 and operable to impart the rotational motion 119 to the drill bit 126. The mud motor 128 may be a directional mud motor connected to or comprising a bent sub 127 (e.g., housing), which may be oriented in a predetermined direction during drilling operations to orient the drill bit 126, and thus steer the drill string 120 along a predetermined path through the formation 106. The side of the mud motor 128 aligned with the direction of the bent sub 127 and the drill bit 126 may be known as "a downhole toolface" 129.

The BHA 124 may also include one or more downhole tools 130 above and/or below the mud motor 128. One or more of the downhole tools 130 may be or comprise a measurement-while-drilling (MWD) or logging-while-drilling (LWD) tool comprising downhole sensors 132 operable for the acquisition of measurement data pertaining to the BHA 124, the wellbore 102, and/or the formation 106. The downhole sensors 132 may comprise an inclination sensor, a rotational position sensor, and/or a rotational speed sensor, which may include one or more accelerometers, magnetometers, gyroscopic sensors (e.g., micro-electro-mechanical system (MEMS) gyros), and/or other sensors for determining the orientation, position, and/or speed of one or more portions of the BHA 124 (e.g., the drill bit 126, a downhole tool 130, and/or the mud motor 128) and/or other portions of the drill string 120 relative to the wellbore 102 and/or the wellsite surface 104. The downhole sensors 132 may comprise a depth correlation tool utilized to determine and/or log position (i.e., depth) of one or more portions of the BHA 124 and/or other portions of the drill string 120 within the wellbore 102 and/or with respect to the wellsite surface 104. One or more of the downhole tools 130 may comprise a telemetry device 136 operable to communicate with the surface equipment 110 via downhole telemetry, such as mud-pulse telemetry and/or electro-magnetic telemetry. One or more of the downhole tools 130 may also comprise a downhole control device 134 (e.g., a processing device, an equipment controller, etc.) operable to receive, process, and/or store data received from the surface equipment 110, the downhole sensors 132, and/or other portions of the BHA 124. The control device 134 may also store executable computer programs (e.g., program code instructions), including for implementing one or more aspects of the operations described herein.

The top drive 116 may be suspended from (supported by) the support structure 112 via a hoisting system operable to impart vertical motion 141 to the top drive 116, and thus the drill string 120 connected to the top drive 116. During drilling operations, the top drive 116, in conjunction with operation of the hoisting system, may advance the drill string 120 into the formation 106 to form the wellbore 102.

The hoisting system may comprise a traveling block 143, a crown block 145, and a drawworks 140 storing a flexible line 142 (e.g., a cable, a wire rope, etc.). The crown block 145 may be connected to and thus supported by the support structure 112, and the traveling block 143 may be connected to and thus support the top drive 116. The drawworks 140 may be mounted to the rig floor 114. The crown block 145 and traveling block 143 may each comprise pulleys or sheaves around which the flexible line 142 is reeved to operatively connect the crown block 145, the traveling block 143, and the drawworks 140.

The drawworks 140 may comprise a drum 144 and an electric motor 146 operatively connected with and operable to rotate the drum 144. The drawworks 140 may selectively impart tension to the flexible line 142 to lift and lower the top drive 116, resulting in the vertical movement 141 of the top drive 116 and the drill string 120 (when connected with the top drive 116). For example, the electric motor 146 may be operable to rotate the drum 144 to reel in the flexible line 142, causing the traveling block 143 and the top drive 116 to move upward. The electric motor 146 may be further operable to rotate the drum 144 to reel out the flexible line 142, causing the traveling block 143 and the top drive 116 to move downward.

A set of slips 148 may be located on the rig floor 114, such as may accommodate the drill string 120 during drill string make up and break out operations, drill string running operations, and drilling operations. The slips 148 may be in an open position to permit advancement of the drill string 120 within the wellbore 102 by the hoisting system, such as during the drill string running operations and the drilling operations. The slips 148 may be in a closed position to clamp the upper end (e.g., the uppermost tubular) of the drill string 120 to thereby suspend and prevent advancement of the drill string 120 within the wellbore 102, such as during the make up and break out operations.

The hoisting system may deploy the drill string 120 into the wellbore 102 through fluid control equipment 150 for maintaining well pressure control and controlling fluid being discharged from the wellbore 102. The fluid control equipment 150 may be mounted on top of a wellhead 152 installed over the wellbore 102.

The well construction system 100 may further include a drilling fluid circulation system or equipment operable to circulate fluids between the surface equipment 110 and the drill bit 126 during drilling and other operations. For example, the drilling fluid circulation system may be operable to inject a drilling fluid from the wellsite surface 104 into the wellbore 102 via an internal fluid passage 121 extending longitudinally through the drill string 120. The drilling fluid circulation system may comprise a pit, a tank, and/or other fluid container 162 holding the drilling fluid 164 (i.e., drilling mud). The drilling fluid circulation system may comprise one or more pumps 160 operable to move the drilling fluid 164 from the container 162 into the fluid passage 121 of the drill string 120 via a fluid conduit 166 (e.g., a stand pipe) extending from the pump 160 to the top drive 116 and an internal passage (not shown) extending through the top drive 116.

During drilling operations, the drilling fluid may continue to flow downhole 123 through the internal passage 121 of the drill string 120. The drilling fluid may exit the BHA 124 via ports 131 in the drill bit 126 and then circulate uphole 125 through an annular space 108 of the wellbore 102. In this manner, the drilling fluid lubricates the drill bit 126 and carries formation cuttings uphole 125 to the wellsite surface 104. The drilling fluid flowing uphole 125 toward the wellsite surface 104 may exit the wellbore 102 via one or more instances of the fluid control equipment 150. The drilling fluid may then pass through one or more fluid conduits 153 (e.g., a gravity line) and drilling fluid reconditioning equipment 154 to be cleaned and reconditioned before returning to the fluid container 162. The drilling fluid reconditioning equipment 154 may also separate drill cuttings 158 from the drilling fluid into a cuttings container 156.

The surface equipment 110 of the well construction system 100 may also comprise a control center 170 from which various portions of the well construction system 100, such as a drill string rotation system (e.g., the top drive 116 and/or a rotary table), a hoisting system (e.g., the drawworks 140, the line 142, and the blocks 143, 145), a tubular handling system (e.g., a catwalk, one or more iron roughnecks, and one or more tubular handling devices, none shown), a drilling fluid circulation system (e.g., one or more mud pumps 160, the drilling fluid container 162, and the fluid conduit 166), a drilling fluid cleaning and reconditioning system (e.g., the fluid cleaning and reconditioning equipment 154), a well control system (e.g., the fluid control devices 150), and the BHA 124, among other examples, may be monitored and controlled. The control center 170 may be located on the rig floor 114. The control center 170 may comprise a facility 171 (e.g., a room, a cabin, a trailer, etc.) containing a control workstation 172, which may be operated by rig personnel 173 (e.g., a driller or another human rig operator) to monitor and control various wellsite equipment or portions of the well construction system 100.

The control workstation 172 may comprise or be communicatively connected with a central control device 174 (e.g., a processing device, an equipment controller, etc.), such as may be operable to receive, process, and output information to monitor operations of and/or provide control to one or more portions of the well construction system 100. For example, the control device 174 may be communicatively connected with the various surface equipment 110 and/or the BHA 124, and may be operable to receive sensor signals (e.g., sensor measurements and/or other data) from and transmit signals (e.g., control commands, signals, and/or other data) to such equipment to perform various operations described herein. The control device 174 may store executable program code, instructions, and/or operational parameters or setpoints, including for implementing one or more aspects of operations described herein. The control device 174 may be located within and/or outside of the facility 171.

The control workstation 172 may be operable for entering or otherwise communicating control commands to the control device 174 by the rig personnel 173, and for displaying or otherwise communicating information from the control device 174 to the rig personnel 173. The control workstation 172 may comprise one or more input devices 176 (e.g., a keyboard, a mouse, a joystick, a touchscreen, etc.) and one or more output devices 178 (e.g., a video monitor, a touchscreen, a printer, audio speakers, etc.). Communication between the control device 174, the input and output devices 176, 178, and the various wellsite equipment may be via wired and/or wireless communication means. However, for clarity and ease of understanding, such communication means are not depicted, and a person having ordinary skill in the art will appreciate that such communication means are within the scope of the present disclosure.

Communication (i.e., telemetry) between the BHA 124 and the control device 174 may be via mud-pulse telemetry (i.e., pressure pulses) sent through the drilling fluid flowing within a fluid passage 121 of the drill string 120. For example, the downhole telemetry device 136 may comprise a modulator selectively operable to modulate the pressure (i.e., cause pressure changes, pulsations, and/or fluctuations) of the drilling fluid flowing within the fluid passage 121 of the drill string 120 to transmit downhole data (i.e., downhole measurements) received from the downhole control device 134, the downhole sensors 132, and/or other portions of the BHA 124 in the form of pressure pulses. The modulated pressure pulses travel uphole along the drilling fluid through the fluid passage 121, the top drive 116, and the fluid conduit 166 to be detected by an uphole telemetry device 168. The uphole telemetry device 168 may comprise a pressure transducer or sensor in contact with the drilling fluid being pumped downhole. The uphole telemetry device 168 may thus be disposed along or in connection with the fluid conduit 166, the top drive 116, and/or another conduit or device transferring or in contact with the drilling fluid being pumped downhole 123. The uphole telemetry device 168 may be operable to detect the modulated pressure pulses, convert the pressure pulses to electrical signals, and communicate the electrical signals to the control device 174. The control device 174 may be operable to interpret the electrical signals to reconstruct the downhole data transmitted by the downhole telemetry device 136.

Other implementations of the well construction system 100 within the scope of the present disclosure may include more or fewer components than as described above and/or depicted in FIG. 1. Additionally, various equipment and/or subsystems of the well construction system 100 shown in FIG. 1 may include more or fewer components than as described above and depicted in FIG. 1. For example, various engines, motors, hydraulics, actuators, valves, and/or other components not explicitly described herein may be included in the well construction system 100, and are within the scope of the present disclosure.

The well construction system 100 may be utilized to perform directional drilling by selectively rotating the drill bit 126 via the top drive 116 and/or the mud motor 128. During non-directional drilling operations, just the top drive 116 or both the top drive 116 and mud motor 128 may rotate the drill bit 126. Such non-directional drilling operations are known in the oil and gas industry as "rotary drilling." To cause the drill string 120 to drill in an intended lateral direction (i.e., to turn), the top drive 116 may stop rotating and then orient (i.e., direct) the downhole toolface 129 in the intended direction. The mud motor 128 may then continue to rotate the drill bit 126 while weight-on-bit is applied, thereby causing the drill string 120 to advance through the formation 106 to extend the wellbore 102 in the intended direction (i.e., in the direction of the downhole toolface 129). Directional drilling performed while the drill bit 126 is oriented in the intended direction by the top drive 116 and rotated by the mud motor 128 is known in the oil and gas industry as "slide drilling."

During slide drilling, at least a portion of the BHA 124 and/or the conveyance means 122 slides along a sidewall 103 of the wellbore 102 that is opposite the direction of the downhole toolface 129. Thus, during slide drilling, a reduced amount of drill string weight is transferred to the drill bit 126 because of axial friction between the sidewall 103 of the wellbore 102 and the drill string 120. The reduced WOB results in a reduced axial contact force between the drill bit 126 and the formation 106 being cut by the drill bit 126, resulting in a reduced ROP through the formation 106. Rotary and slide drilling operations may be alternated to steer the drill string 120 and form a deviated wellbore 102 along a predetermined path through the formation 106. Typically, an entire wellbore 102 can be drilled through a combination of rotary drilling (with higher ROP, but no control over wellbore trajectory) and slide drilling (with lower ROP, but with control of the wellbore trajectory).

The present disclosure is further directed to various implementations of systems and/or methods for monitoring and controlling slide drilling operations to reduce axial friction between the drill string 120 and the sidewall 103 of the wellbore 102, and thus increase or otherwise optimize efficiency (e.g., ROP) of slide drilling operations through the formation 106. The systems and/or methods within the scope of the present disclosure may be utilized to determine operational set-points of certain operational parameters (e.g., torque and rotational distance) for the top drive 116 and then monitor (i.e., measure) and control the operational parameters based the determined operational set-points. For example, the systems and/or methods within the scope of the present disclosure may cause the top drive 116 to rotate the drill string 120 in alternating (i.e., opposite) rotational directions in an oscillating manner based the determined operational set-points to lower the axial friction between the drill string 120 and the sidewall 103 of the wellbore 102, thereby increasing weight transfer to the drill bit 126, resulting in a higher ROP, while also controlling directional orientation of the downhole toolface 129.

Figure 2:
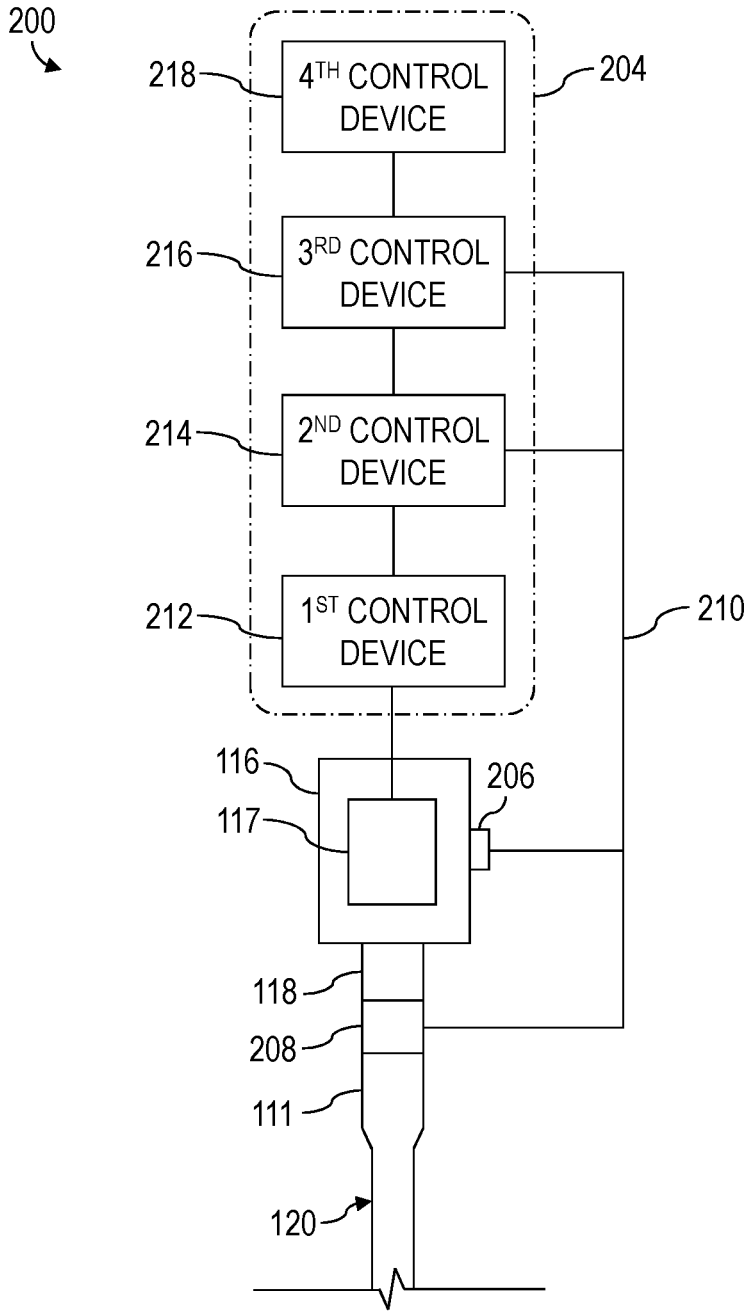
FIG. 2 is a schematic view of at least a portion of an example implementation of apparatus according to one or more aspects of the present disclosure.

FIG. 2 is a schematic view of at least a portion of an example implementation of a control system 200 for monitoring and controlling operation of a top drive 116 to perform or otherwise during slide drilling operations according to one or more aspects of the present disclosure. The control system 200 may be utilized to monitor and control operation of the top drive 116, namely, an electric motor 117 operatively connected with a drive shaft 118, so as to control rotational (i.e., angular or azimuthal) speed and rotational position of the drive shaft 118. The control system 200 may form a portion of or operate in conjunction with the well construction system 100 shown in FIG. 1, and thus may comprise one or more features of the well construction system 100 shown in FIG. 1, including where indicated by the same reference numerals. Accordingly, the following description refers to FIGS. 1 and 2, collectively.

The control system 200 may comprise one or more control devices 204 (i.e., controllers), such as, for example, variable frequency drives (VFDs), programmable logic controllers (PLCs), computers (PCs), industrial computers (IPC), or information processing devices equipped with control logic. The control system 200 may further comprise various sensors associated with the top drive 116. One or more of the control devices 204 may be communicatively connected with the sensors and the motor 117. One or more of the control devices 204 may be in real-time communication with the sensors and the motor 117, such as for monitoring and/or controlling operation of the top drive 116. Communication between one or more of the control devices 204 and the sensors and the motor 117 may be via wired and/or wireless communication means 210. A person having ordinary skill in the art will appreciate that such communication means are within the scope of the present disclosure.

The control system 200 may comprise one or more rotation sensors 206 operatively connected with and/or disposed in association with the top drive 116. The rotation sensor 206 may be operable to output or otherwise facilitate rotational position measurements (e.g., sensor signals or information) indicative of rotational (i.e., angular or azimuthal) position of the drive shaft 118 of the top drive 116. The rotation sensor 206 may be communicatively connected with one or more of the control devices 204 for transmitting the rotational position measurements to one or more of the control devices 204. The rotation sensor 206 may be disposed or installed in association with, for example, the electric motor 117 to monitor rotational position of the electric motor 117, and thus the drive shaft 118. The rotation sensor 206 may be disposed or installed in association with, for example, a rotating member of a gear box (not shown) to monitor rotational position of the rotating member, and thus the drive shaft 118. The rotation sensor 206 may be disposed or installed in direct association with, for example, the drive shaft 118 to monitor rotational position of the drive shaft 118. The rotation sensor may further output or otherwise facilitate rotational distance (i.e., rotational angle or number of rotations) measurements, rotational speed (i.e., revolutions per minute (RPM)) measurements, and rotational acceleration measurements of the electric motor 117 and/or the drive shaft 118. The rotation sensor 206 may be or comprise an encoder, a rotary potentiometer, and/or a rotary variable-differential transformer (RVDT), among other examples.

The control system 200 may further comprise one or more electrical devices, each operable to output or otherwise facilitate torque measurements (e.g., signals or information) indicative of torque output by the top drive 116 to an upper end 111 of the drill string 120. For example, the control system 200 may comprise a torque sensor 208 (e.g., a torque sub) operable to output or otherwise facilitate torque measurements (e.g., signals or information) indicative of torque applied by the top drive 116 to the upper end 111 of the drill string 120. The torque sensor 208 may be communicatively connected with one or more of the control devices 204 for transmitting the torque measurements to one or more of the control devices 204. The torque sensor 208 may be mechanically connected or otherwise disposed between the drive shaft 118 and the upper end 111 of the drill string 120, such as may permit the torque sensor 208 to transfer and measure torque. The torque sensor 208 may further output or otherwise facilitate rotational position measurements, rotational distance measurements, rotational speed measurements, and rotational acceleration measurements of the drive shaft 118.

The control devices 204 may be divided into or otherwise comprise hierarchical control levels or layers. A first control level may comprise a first control device 212 (i.e., an actuator control device), such as, for example, a VFD operable to directly power and control (i.e., drive) the electric motor 117 of the top drive 116. The first control device 212 may be electrically connected with the electric motor 117. The first control device 212 may control electrical power (e.g., current, voltage, frequency, etc.) delivered to the electric motor 117 to control operation (e.g., rotational speed and torque) of the electric motor 117, and thus the drive shaft 118 of the top drive 116. The first control device 212 may also operate as a torque sensor operable to calculate or otherwise determine torque generated or output by the electric motor 117 based on electrical power (e.g., current, voltage, frequency, etc.) delivered to the electric motor 117. The first control device 212 may thus be operable to output or otherwise facilitate torque measurements (e.g., signals or information) indicative of torque output by the top drive 116 to the upper end 111 of the drill string 120. The first control device 212 may be communicatively connected with one or more of the other control devices 204 for transmitting the torque measurements to one or more of the other control devices 204.

A second control level may comprise a second control device 214 (i.e., a direct or local control device), such as, for example, a PLC operable to control the electric motor 117 of the top drive 116 via the first control device 212. The second control device 214 may be imparted with and operable to execute computer program code instructions, such as rigid computer programing. The second control device 214 may be communicatively connected with the first control device 212, may be operable to receive torque and other measurements from the first control device 212, and may output control signals or information to the first control device 212 to control the rotational position, rotational distance, rotational speed, and/or torque of the electric motor 117. The second control device 214 may be communicatively connected with the rotation sensor 206 and may be operable to receive the rotational position measurements, the rotational distance measurements, the rotational speed measurements, and/or the rotational acceleration measurements facilitated by the rotation sensor 206. The second control device 214 may be communicatively connected with the torque sensor 208 and may be operable to receive the torque measurements facilitated by the torque sensor 208. The second control device 214 may be a fast-loop control device, which may operate at a sampling rate between about ten hertz (Hz) and about one kilohertz (kHz).

A third control level may comprise a third control device 216 (i.e., a coordinated or central control device), such as, for example, a PC, an IPC, and/or another processing device. The third control device 216 may be imparted with and operable to execute program code instructions, including high-level programming languages, such as C and C++, among other examples, and may be used with computer program code instructions running in a real-time operating system (RTOS). The third control device 216 may be a system-wide control device operable to control a piece of well construction equipment and/or several pieces (i.e., a subsystem) of well construction equipment. The third control device 216 may be or form at least a portion of the central control device 174 shown in FIG. 1. The third control device 216 may be operable to control the electric motor 117 of the top drive 116 via the first and/or second control devices 212, 214. The third control device 216 may be communicatively connected with the second control device 214 and may be operable to receive torque and other measurements from the first control device 212 via the second control device 214. The third control device 216 may be operable to output control signals or information to the first control device 212 via the second control device 214 to control the rotational position, rotational distance, rotational speed, and/or torque of the top drive 116. The third control device 216 may be communicatively connected with the rotation sensor 206 and may be operable to receive rotational position, rotational distance, rotational speed, and/or rotational acceleration measurements facilitated by the rotation sensor 206. The third control device 216 may be communicatively connected with the torque sensor 208 and may be operable to receive the torque measurements facilitated by the torque sensor 208. The third control device 216 may be a mid-speed control device, which may operate at a sampling rate between about ten Hz and about 100 Hz.

A fourth control level may comprise a fourth control device 218 (i.e., an orchestration or supervisory control device), such as, for example, a PC, an IPC, and/or another processing device. The fourth control device 218 may be imparted with and operable to execute computer program code instructions, including supervisory software for high-level control of the drilling operations of the well construction system 100. The fourth control device 218 may be or form at least a portion of the control device 174 shown in FIG. 1. The fourth control device 218 may be operable to control the electric motor 117 of the top drive 116 via the first, second, and third control devices 212, 214, 216. The fourth control device 218 may be communicatively connected with the third control device 216 and may be operable to receive torque and other measurements from the first control device 212 via the second and third control devices 214, 216. The fourth control device 218 may be operable to output control signals or information to the first control device 212 via the second and third control devices 214, 216 to control the rotational position, rotational distance, rotational speed, and/or torque of the electric motor 117. The fourth control device 218 may be a low-speed control device, which may operate at a sampling rate ranging from about one (1) or several seconds to about one (1) or several minutes.

Figure 3:
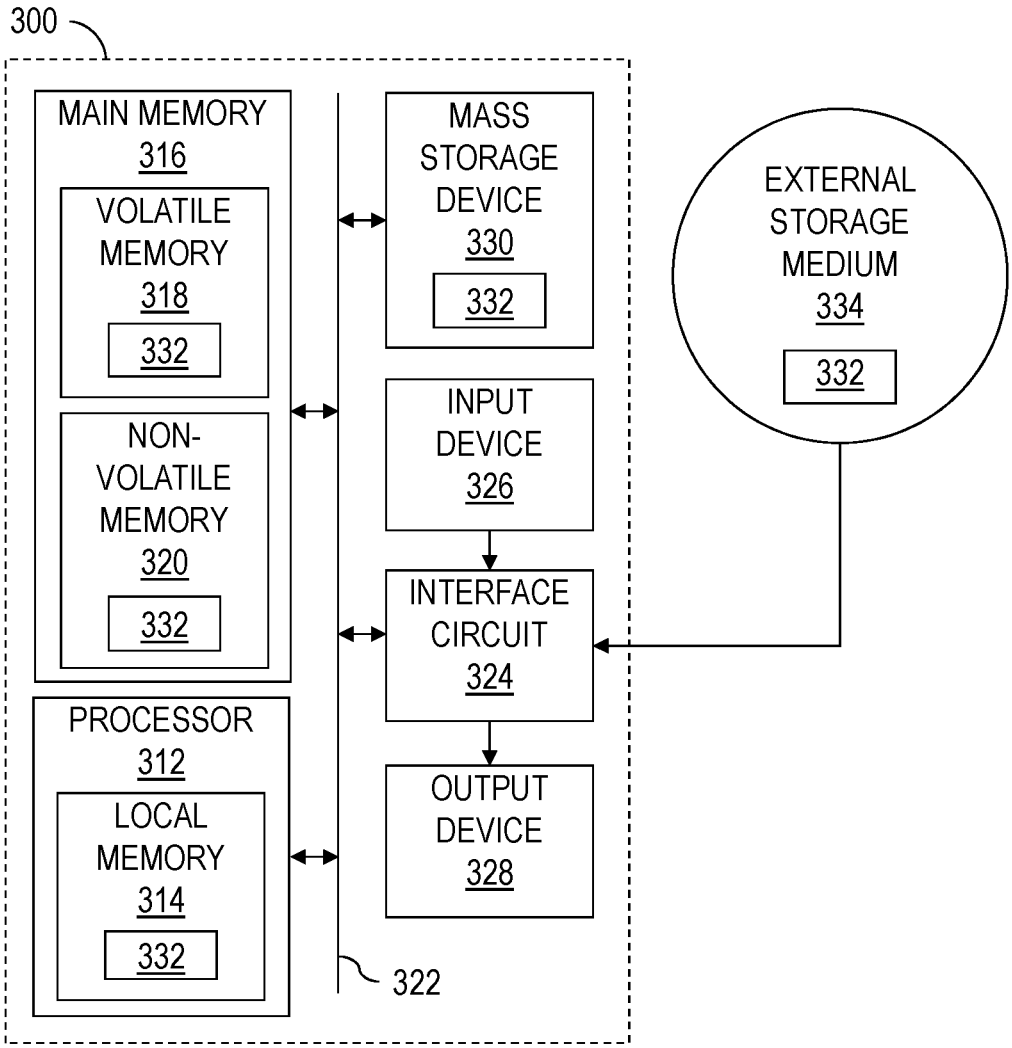
FIG. 3 is a schematic view of at least a portion of an example implementation of apparatus according to one or more aspects of the present disclosure.

FIG. 3 is a schematic view of at least a portion of an example implementation of a processing device 300 (or system) according to one or more aspects of the present disclosure. The processing device 300 may be or form at least a portion of one or more processing devices, equipment controllers, and/or other electronic devices shown in one or more of FIGS. 1 and 2. Accordingly, the following description refers to FIGS. 1-3, collectively.

The processing device 300 may be or comprise, for example, one or more processors, controllers, special-purpose computing devices, PCs (e.g., desktop, laptop, and/or tablet computers), personal digital assistants, smartphones, IPCs, PLCs, servers, internet appliances, and/or other types of computing devices. The processing device 300 may be or form at least a portion of one or more of the control devices 134, 174 shown in FIG. 1 and/at least a portion of one or more of the control devices 204 shown in FIG. 2. Although it is possible that the entirety of the processing device 300 is implemented within one device, it is also contemplated that one or more components or functions of the processing device 300 may be implemented across multiple devices, some or an entirety of which may be at the wellsite and/or remote from the wellsite.

The processing device 300 may comprise a processor 312, such as a general-purpose programmable processor. The processor 312 may comprise a local memory 314 and may execute machine-readable and executable program code instructions 332 (i.e., computer program code) present in the local memory 314 and/or another memory device. The processor 312 may execute, among other things, the program code instructions 332 and/or other instructions and/or programs to implement the example methods, processes, and/or operations described herein. For example, the program code instructions 332, when executed by the processor 312 of the processing device 300, may cause a top drive 116 to perform example methods and/or operations described herein. The program code instructions 332, when executed by the processor 312 of the processing device 300, may also or instead cause the processor 312 to receive and process sensor data (e.g., operational measurements) facilitated by one or more of the sensors 206, 208 and output control commands for controlling the electric motor 117 of the top drive 116 based on the program code instructions 332, the received sensor data, and predetermined operational set-points.

The processor 312 may be, comprise, or be implemented by one or more processors of various types suitable to the local application environment, such as one or more general-purpose computers, special-purpose computers, microprocessors, digital signal processors (DSPs), field-programmable gate arrays (FPGAs), application-specific integrated circuits (ASICs), and/or processors based on a multi-core processor architecture, as non-limiting examples. Examples of the processor 312 include one or more INTEL microprocessors, microcontrollers from the ARM and/or PICO families of microcontrollers, and/or embedded soft/hard processors in one or more FPGAs.

The processor 312 may be in communication with a main memory 316, such as may include a volatile memory 318 and a non-volatile memory 320, perhaps via a bus 322 and/or other communication means. The volatile memory 318 may be, comprise, or be implemented by random access memory (RAM), static RAM (SRAM), dynamic RAM (DRAM), synchronous DRAM (SDRAM), RAMBUS DRAM (RDRAM), concurrent RDRAM (CRDRAM), direct RDRAM (DRDRAM), and/or other types of random access memory devices. The non-volatile memory 320 may be, comprise, or be implemented by read-only memory, flash memory, and/or other types of memory devices. One or more memory controllers (not shown) may control access to the volatile memory 318 and/or non-volatile memory 320.

The processing device 300 may also comprise an interface circuit 324, which is in communication with the processor 312, such as via the bus 322. The interface circuit 324 may be, comprise, or be implemented by various types of standard interfaces, such as an Ethernet interface, a universal serial bus (USB), a third-generation input/output (3GIO) interface, a wireless interface, a cellular interface, and/or a satellite interface, among others. The interface circuit 324 may comprise a graphics driver card. The interface circuit 324 may comprise a communication device, such as a modem or network interface card to facilitate exchange of data with external computing devices via a network (e.g., Ethernet connection, digital subscriber line (DSL), telephone line, coaxial cable, cellular telephone system, satellite, etc.).

The processing device 300 may be in communication with various sensors, video cameras, actuators, processing devices, equipment controllers, and other devices of the well construction system via the interface circuit 324. The interface circuit 324 can facilitate communications between the processing device 300 and one or more devices by utilizing one or more communication protocols, such as an Ethernet-based network protocol (such as ProfiNET, OPC, OPC/UA, Modbus TCP/IP, EtherCAT, UDP multicast, Siemens S7 communication, or the like), a fieldbus communication protocol (such as PROFIBUS, Canbus, etc.), a proprietary communication protocol, and/or another communication protocol.

One or more input devices 326 may also be connected to the interface circuit 324. The input devices 326 may permit human users (e.g., rig personnel) to enter the program code instructions 332, which may be or comprise control commands, operational parameters, operational thresholds, and/or other operational set-points. The program code instructions 332 may further comprise modeling or predictive routines, equations, algorithms, processes, applications, and/or other programs operable to perform example methods and/or operations described herein. The input devices 326 may be, comprise, or be implemented by a keyboard, a mouse, a joystick, a touchscreen, a trackpad, a trackball, and/or a voice recognition system, among other examples.

One or more output devices 328 may also be connected to the interface circuit 324. The output devices 328 may permit visualization or other sensory perception of various data, such as sensor data, status data, and/or other example data. The output devices 328 may be, comprise, or be implemented by video output devices (e.g., a liquid-crystal display (LCD), a light-emitting diode (LED) display, a cathode-ray tube (CRT) display, a touchscreen, etc.), printers, and/or speakers, among other examples. The one or more input devices 326 and/or the one or more output devices 328 connected to the interface circuit 324 may, at least in part, facilitate the HMIs described herein.

The processing device 300 may comprise a mass storage device 330 for storing data and program code instructions 332. The mass storage device 330 may be connected to the processor 312, such as via the bus 322. The mass storage device 330 may be or comprise a tangible, non-transitory storage medium, such as a floppy disk drive, a hard disk drive, a compact disk (CD) drive, a digital versatile disk (DVD) drive, and/or a flash drive, among other examples. The processing device 300 may be communicatively connected with an external storage medium 334 via the interface circuit 324. The external storage medium 334 may be or comprise a removable storage medium (e.g., a CD or DVD), such as may be operable to store data and program code instructions 332.

As described above, the program code instructions 332 and other data (e.g., sensor data or measurements database) may be stored in the mass storage device 330, the main memory 316, the local memory 314, and/or the removable storage medium 334. Thus, the processing device 300 may be implemented in accordance with hardware (perhaps implemented in one or more chips including an integrated circuit, such as an ASIC), or may be implemented as software or firmware for execution by the processor 312. In the case of firmware or software, the implementation may be provided as a computer program product including a non-transitory, computer-readable medium or storage structure embodying computer program code instructions 332 (i.e., software or firmware) thereon for execution by the processor 312. The program code instructions 332 may comprise program instructions or computer program code that, when executed by the processor 312, may perform and/or cause performance of example methods, processes, and/or operations described herein.

The present disclosure is further directed to example methods (e.g., operations and/or processes) that can be performed while performing or to facilitate performance of slide drilling operations via a drill string driver (e.g., a top drive). The methods may be performed by utilizing (or otherwise in conjunction with) at least a portion of one or more implementations of one or more instances of the apparatus shown in one or more of FIGS. 1-3, and/or otherwise within the scope of the present disclosure. The methods may be caused to be performed, at least partially, by a control device (i.e., a processing device), such as one or more of the control devices 204 executing program code instructions according to one or more aspects of the present disclosure. Thus, the present disclosure is also directed to a non-transitory, computer-readable medium comprising computer program code that, when executed by the control devices, may cause such control devices to perform the example methods described herein. The methods may also or instead be caused to be performed, at least partially, by a human operator (e.g., rig personnel) utilizing one or more instances of the apparatus shown in one or more of FIGS. 1-3, and/or otherwise within the scope of the present disclosure. Thus, the following description of example methods refer to apparatus shown in one or more of FIGS. 1-3. However, the methods may also be performed in conjunction with implementations of apparatus other than those depicted in FIGS. 1-3 that are also within the scope of the present disclosure.

An example method according to one or more aspects of the present disclosure may comprise calibrating, selecting, or otherwise determining optimal operational parameters (i.e., characteristics) of rotational (i.e., angular or azimuthal) motion of a drill string driver, including operational parameters of alternating rotations (i.e., rotational oscillations) imparted to an upper end 111 of a drill string 120 by a drill string driver in alternating clockwise and counterclockwise directions to optimize transfer of the axial load of the drill string 120 to the bottom of a wellbore 102, and thus optimize efficiency (e.g., maximize ROP) of slide drilling operations. For the sake of clarity and ease of understanding, the methods introduced below are described in the context of a top drive 116 implementation, it being understood that the methods are also applicable to or readily adaptable for use with other drill string drivers, such as a rotary table, instead of or in addition to the top drive 116.

An example method may comprise determining various operational parameters of rotational motion of the top drive 116, such as rotational orientation of a downhole toolface 129, rotational speed imparted by the top drive 116 to the upper end 111 of the drill string 120 via a drive shaft 118 of the top drive 116, level or amount of torque (referred to hereinafter as "drill string torque") imparted by the top drive 116 to the upper end 111 of the drill string 120 via the drive shaft 118, and rotational distance of alternating rotations imparted by the top drive 116 to the upper end 111 of the drill string 120 via the drive shaft 118. A rotational distance may comprise or be defined as a total (or cumulative) angle (or number of rotations) imparted to the upper end 111 of the drill string 120 by the top drive 116 in the clockwise or counterclockwise direction.

An example method may comprise determining a reference drill string torque that is to be imparted to the upper end 111 of the drill string 120 by the top drive 116 in alternating clockwise and counterclockwise directions. The reference drill string torque may comprise or be defined as a drill string torque imparted to the upper end 111 of the drill string 120 by the top drive 116 in the clockwise and counterclockwise directions that is sufficient to rotate the entire drill string 120. The reference drill string torque may be implemented during slide drilling operations to optimize efficiency of the slide drilling operations, but without changing orientation of the downhole toolface 129, and thus direction of drilling through the formation 106. The reference drill string torque may be utilized to scale or otherwise determine a base (or background) drill string torque that may be imparted to the upper end 111 of the drill string 120 to perform the slide drilling operations. The base drill string torque may comprise or be defined as a portion or fraction of the value of the reference drill string torque.

The reference drill string torque may be determined by the control system 200 (e.g., one or more control devices 204) by controlling (i.e., causing) and monitoring actions of various portions of the well construction system 100. Such actions may include, for example, initiating operation of the drawworks 140 to cause the drawworks 140 to lift or otherwise position the drill string 120 within the wellbore 102 such that the drill string 120 is not in contact with the bottom of the wellbore 102 (i.e., off-bottom). Thereafter, initiating operation of the pumps 160 to cause the pumps 160 to pump drilling fluid through the drill string 120. Before or after initiating operation of the pumps 160, initiating operation of the top drive 116 to cause the top drive 116 to rotate the drill string 120 at a predetermined or otherwise intended rotational speed (e.g., between about 10 RPM and about 50 RPM) while the drill string 120 is off-bottom. For example, the control system 200 may cause the top drive 116 to increase rotational speed of the top drive 116 until the intended rotational speed of the top drive 116 is reached, and then maintain such intended rotational speed until the control system 200 determines the reference drill string torque. While the pumps 160 are pumping the drilling fluid through the drill string 120, the drill string 120 is being rotated by the top drive 116, and the drill string 120 is off-bottom, the drill string torque imparted to the upper end 111 of the drill string 120 by the top drive 116 may be measured. The control system 200 may then determine the reference drill string torque based on such torque measurements. The rotation sensor 206 may be operable to facilitate the rotational speed measurements indicative of rotational speed of the drive shaft 118, and thus indicative of the rotational speed imparted by the top drive 116 to the upper end 111 of the drill string 116.

Figure 4:
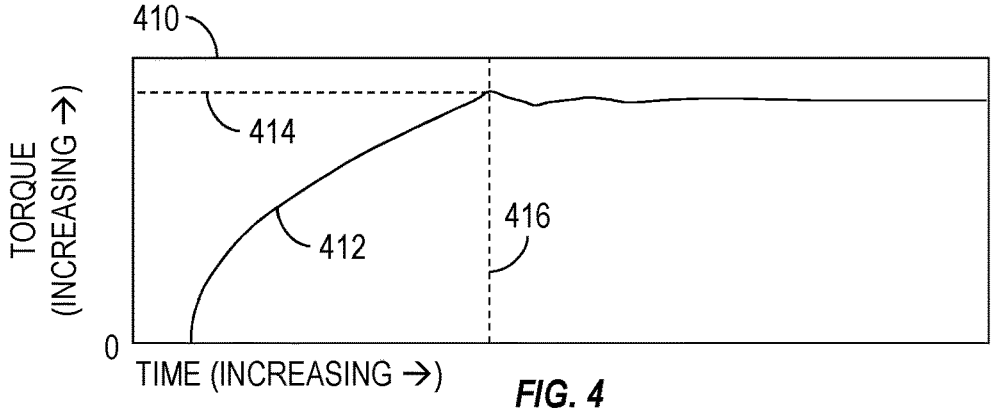
FIGS. 4-7 are graphs related to one or more aspects of the present disclosure.

FIG. 4 is a graph 410 showing example drill string torque measurements 412 that may be imparted to the upper end 111 of the drill string 120 via the drive shaft 118 of the top drive 116 while the pumps 160 are pumping the drilling fluid through the drill string 120, the drill string 120 is being rotated by the top drive 116, and the drill string 120 is off-bottom. The graph 410 may be generated by the control system 200 (e.g., the processing device 300 shown in FIG. 3 or one or more of the control devices 204 shown in FIG. 2). The graph 410 shows the drill string torque measurements 412, plotted along the vertical axis, with respect to time, plotted along the horizontal axis. The control system 200 may receive and record the drill string torque measurements 412. The following description refers to FIGS. 1-4, collectively.

The drill string torque measurements 412 may be output or otherwise facilitated by the torque sensor 208 shown in FIG. 2. The drill string torque measurements 412 may also or instead be determined by calculating torque (referred to hereinafter as "top drive torque") output by the electric motor 117 of the top drive 116, and then adjusting the top drive torque based on mechanical properties of the top drive 116. The top drive torque may be measured or otherwise determined based on measurements of electrical current transmitted to the electric motor 117 by the first control device 212 (e.g., a VFD) of the top drive 116. The drill string torque may be determined, for example, by utilizing Equation (1) set forth below.

$$T_{ds}=T_{td}-J_{td}\alpha_{td} \tag{1}$$

where $T_{ds}$ is the drill string torque, $T_{td}$ is the top drive torque output by the electric motor 117 of the top drive 116, $J_{td}$ is the rotational inertia of the top drive 116, and $\alpha_{td}$ is the rotational acceleration of the drive shaft 118. The rotational acceleration $\alpha_{td}$ may be determined by utilizing Equation (2) set forth below.

$$\alpha_{td} = \frac{\omega_2 - \omega_1}{dt} \tag{2}$$

where $\omega_1$ indicates rotational speed of the drive shaft 118 at a first time, $\omega_2$ indicates rotational speed of the drive shaft 118 at a subsequent second time, and dt indicates the time interval between the first and second times. However, if the torque sensor 208 is used to facilitate the drill string torque measurements 412, then Equations (1) and (2) may be disregarded and the drill string torque measurements 412 may be deemed as being equal to the torque measurements facilitated by the torque sensor 208.

The control system 200 may determine the reference drill string torque based on the drill string torque measurements 412 recorded by the control system 200 while the pumps 160 are pumping the drilling fluid through the drill string 120, the drill string 120 is being rotated by the top drive 116, and the drill string 120 is off-bottom. The drill string torque measurements 412 shown in graph 410 indicate that the drill string torque is increasing while the drill string torque progressively accelerates the drill string 120 from the upper end 111 to the drill bit 126. The drill string torque then decreases or remains substantially constant (i.e., unchanged) when the entire drill string 120 starts to rotate. The drill string torque measurements 412 reach a maximum drill string torque 414 at a time 416, indicating that the entire drill string 120 (from the upper end 111 to the drill bit 126) is rotating. In other words, during the period leading up to the "full-rotation" time 416, a decreasing portion of the drill string 120 remains stationary in the wellbore 102. The maximum drill string torque 414 required to initiate rotation of the entire drill string 120 may be deemed as or otherwise determined to be the reference drill string torque. In other words, the reference drill string torque is the torque output by the top drive 116 to the upper end 111 of the drill string 120 that causes the lower end of the drill string 120 to start rotating.

As described above, the reference drill string torque may be utilized to scale or otherwise determine the base drill string torque, which may be imparted to the upper end 111 of the drill string 120 to perform the slide drilling operations. The base drill string torque imparted by the top drive 116 to the upper end 111 of the drill string 120 may be selected to be lesser than the reference drill string torque. For example, the base drill string torque may be between about 50% and 100% of the reference drill string torque, between about 50% and 90% of the reference drill string torque, between about 50% and 80% of the reference drill string torque, between about 60% and 90% of the reference drill string torque, between about 60% and 80% of the reference drill string torque, between about 60% and 70% of the reference drill string torque, between about 70% and 90% of the reference drill string torque, or between about 70% and 80% of the reference drill string torque. The base drill string torque imparted by the top drive 116 to the upper end 111 of the drill string 120 may instead be selected to be equal to the reference drill string torque. The base drill string torque imparted by the top drive 116 to the upper end 111 of the drill string 120 may instead be selected to be greater than the reference drill string torque. For example, the base drill string torque may be between about 100% and 125% of the reference drill string torque, between about 100% and 110% of the reference drill string torque, or between about 100% and 105% of the reference drill string torque.

To perform the slide drilling operations, control system 200 may cause the top drive 116 to orient (i.e., rotate) the toolface 129 to an initial rotational position, in which the toolface 129 of the bent sub 127 and the drill bit 126 is oriented in an intended (initial) direction (i.e., an intended direction of drilling). The top drive 116 may then be caused to impart a base drill string torque to the upper end 111 of the drill string 120 alternatingly in opposing clockwise and counterclockwise directions to impart alternating rotations (i.e., rotational oscillations) to the upper end 111 of the drill string 120. The base drill string torque imparted by the top drive 116 to the upper end 111 of the drill string 120 may be larger (e.g., between about 5% and 25%) in the clockwise direction than in the counterclockwise direction to counter or equalize with torque applied to the lower end of the drill sting 120 by the mud motor 128 rotating the drill bit 126 against the formation 106. The drawworks 140 may then be caused to lower the drill string 120 at an intended speed within the wellbore 102 to perform the slide drilling operations to continue drilling the wellbore 102 through the formation 106 at an intended ROP.

During the slide drilling operations, the top drive 116 may rotate the upper end 111 of the drill string 120 in a first (e.g., clockwise) rotational direction from an initial position until the top drive 116 outputs the base drill string torque to the upper end 111 of the drill string 120, at which time the top drive 116 may reverse direction and rotate the upper end 111 of the drill string 120 in a second (e.g., counterclockwise) direction past the initial position until the top drive 116 outputs the base drill string torque to the upper end 111 of the drill string 120. During the slide drilling operations, the top drive 116 may continuously impart the base drill string torque to the upper end 111 of the drill string 120 alternatingly in opposing clockwise and counterclockwise directions. As described above, the base drill string torque may be larger in the clockwise direction than in the counterclockwise direction and may be or comprise a fraction of the reference drill string torque or otherwise be based on the reference drill string torque.

Figure 5:
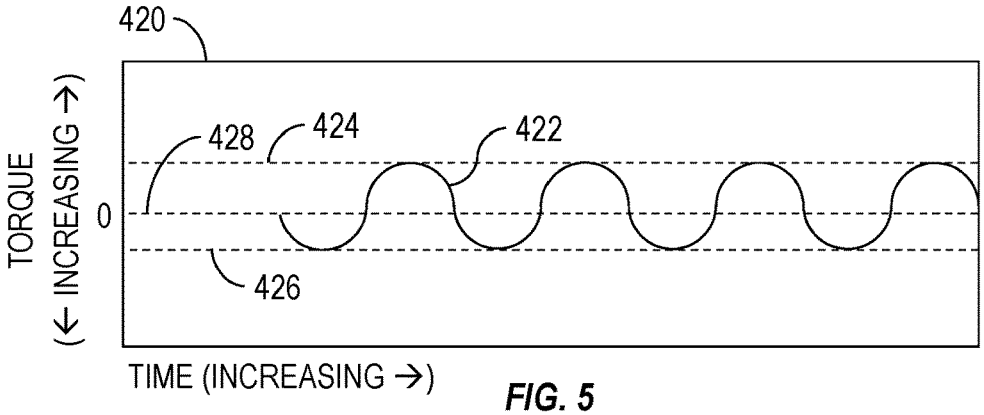

FIG. 5 is a graph 420 showing example drill string torque measurements 422 indicative of the drill string torque imparted to the upper end 111 of the drill string 120 via the drive shaft 118 of the top drive 116 in an alternating manner (i.e., in opposing clockwise and counterclockwise directions) while performing the slide drilling operations based on the reference drill string torque (i.e., by using the reference drill string torque). The graph 420 may be generated by the control system 200 (e.g., the processing device 300 shown in FIG. 3 or one or more of the control devices 204 shown in FIG. 2). The graph 420 shows the drill string torque measurements 422, plotted along the vertical axis, with respect to time, plotted along the horizontal axis. The drill string torque measurements 422 may be output or otherwise facilitated by the torque sensor 208 shown in FIG. 2. The control system 200 may receive and record the drill string torque measurements 422. The following description refers to FIGS. 1-5, collectively.

The drill string torque measurements 422 show that the drill string torque alternates in opposing directions between a first base drill string torque 424 in a first rotational direction and a second base drill string torque 426 in a second rotational direction. The upward direction on the graph 420 may be the clockwise direction and the downward direction on the graph 420 may be the counterclockwise direction. The drill string torque may be measured with respect to an initial (e.g., a midpoint) position (e.g., an initial position 438 shown in FIG. 6) at which the drill string torque is zero (as at 428). Thus, the control system 200 may cause the top drive 116 to alternatingly rotate the upper end 111 of the drill string 120 in opposing clockwise and counterclockwise directions based on the reference drill string torque to perform the slide drilling operations by causing the drive shaft 118 of the top drive 116 to stop each alternating rotation when the drill string torque measurements 422 indicate that the base drill string torque 424, 426 (i.e., a predetermined fraction of the reference drill string torque) is reached. For example, the control system 200 may cause the top drive 116 to alternatingly rotate the upper end 111 of the drill string 120 in opposing directions based on the reference drill string torque to perform the slide drilling operations by causing the drive shaft 118 of the top drive 116 to rotate in a first rotational direction from the initial rotational position until the torque measurements 422 indicate that the first base drill string torque 424 (i.e., a first predetermined fraction of the reference drill string torque) is reached, and in a second rotational direction past the initial rotational position until the torque measurements 422 indicate that the second base drill string torque 426 (i.e., a second predetermined fraction of the reference torque) is reached. The base drill string torque may also be slightly larger in the clockwise direction than in the counterclockwise direction.

An example method according to one or more aspects of the present disclosure may further comprise determining a reference rotational distance of alternating rotations (i.e., rotational oscillations) that are to be imparted to the upper end 111 of the drill string 120 by the top drive 116 in alternating clockwise and counterclockwise directions to perform or continue performing subsequent slide drilling operations. The reference rotational distance may be determined by the control system 200 controlling (i.e., causing) and monitoring actions of various portions of the well construction system 100. For example, the reference rotational distance of a rotation (i.e., an oscillation) may be determined based on rotational distance measurements taken while the top drive 116 imparts the base drill string torque in an alternating manner to the upper end 111 of the drill string 120 to perform the slide drilling operations. The determined reference rotational distance may be implemented during subsequent slide drilling operations to optimize efficiency of the slide drilling operations. The reference rotational distance may be utilized to scale or otherwise as a basis to determine a base (or background) rotational distance of the alternating rotations that may be imparted to the upper end 111 of the drill string 120 to perform the slide drilling operations.

Figure 6:
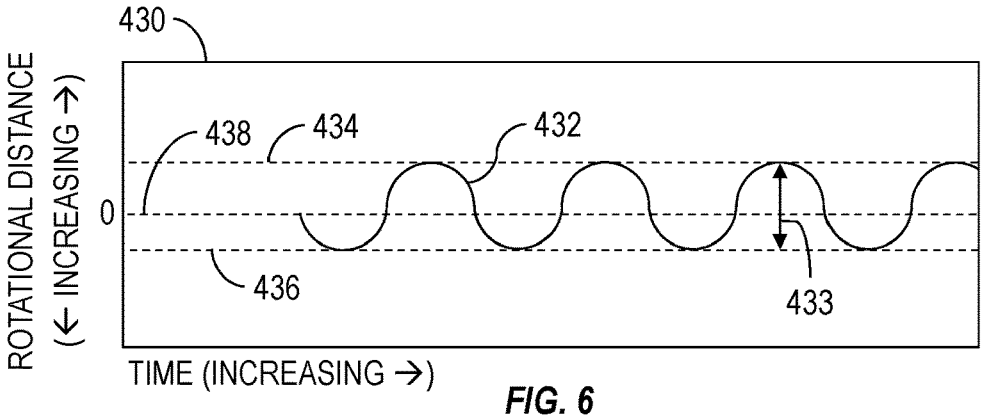

FIG. 6 is a graph 430 showing example rotational distance measurements 432 indicative of rotational distance of the drive shaft 118 of the top drive 116 through which the drive shaft 118 and thus the upper end 111 of the drill string 120 rotates in association with (or caused by) the base drill string torque 424, 426 shown in graph 420. The graph 430 may be generated by the control system 200 (e.g., the processing device 300 shown in FIG. 3 or one or more of the control devices 204 shown in FIG. 2). The graph 430 shows the rotational distance measurements 432, plotted along the vertical axis, with respect to time, plotted along the horizontal axis. The rotational distance measurements 432 may be output or otherwise facilitated by the rotation sensor 206 shown in FIG. 2. The control system 200 may receive and record the rotational distance measurements 432. The following description refers to FIGS. 1-6, collectively.

The rotational distance measurements 432 show that the rotational distance alternates in opposing directions between a first rotational distance 434 in a first rotational direction and a second rotational distance 436 in a second rotational direction. The upward direction on the graph 430 may be the clockwise direction and the downward direction on the graph 430 may be the counterclockwise direction. The rotational distance may be measured with respect to an initial (i.e., zero) position 438 (e.g., an initial rotational position of the toolface 129). The rotational distance with respect to the initial position 438 may be slightly larger in the clockwise direction than in the counterclockwise direction. The rotational distance measurements 432 may be taken while the top drive 116 imparts the base drill string torque 424, 426 in an alternating manner to the upper end 111 of the drill string 120 to perform the slide drilling operations. Thus, the operational measurements 422, 432 in each graph 420, 430 are shown with respect to the same time scale plotted along the horizontal axis, thereby showing contemporaneous and thus corresponding changes (or progression) to rotational distance of the upper end 111 of the drill string 120 (indicated by the rotational distance measurements 432) associated with (or caused by) the drill string torque imparted to the upper end 111 of the drill string 120 (indicated by the drill string torque measurements 422) during the slide drilling operations. Although the top drive 116 simultaneously imparts torque and rotational distance to the upper end 111 of the drill string 120, the opposing peaks of the rotational distance measurements 432 may be out of phase with (e.g., lag behind) the opposing peaks of the torque measurements 422.

After a predetermined period of time or a predetermined number of alternating rotations are performed during the slide drilling operations, the control system 200 may determine a reference rotational distance based on the rotational distance measurements 432 recorded during the slide drilling operations. For example, the control system 200 may calculate an average rotational distance 433 (i.e., an average amplitude) of the alternating rotations of the upper end 111 of the drill string 120 caused by the top drive 116. The average rotational distance 433 may be or comprise an average amplitude or distance between the opposing first and second rotational distances 434, 436. The average rotational distance 433 may be deemed as or otherwise determined to be the reference rotational distance. Accordingly, the slide drilling operations during which the rotational distance measurements 432 are recorded to determine the reference rotational distance 433 may be referred to as a test or calibration (i.e., tuning) stage or portion of the slide drilling operations.

The reference rotational distance may be scaled or otherwise utilized as a basis to determine the base rotational distance of rotational oscillations that may be imparted to the upper end 111 of the drill string 120 to perform or continue performing subsequent calibrated (i.e., post-calibration or tuned) stage or portion of the slide drilling operations. The base rotational distance imparted by the top drive 116 to the upper end 111 of the drill string 120 may be selected to be lesser than the reference rotational distance. For example, the base rotational distance may be between about 50% and 100% of the reference rotational distance, between about 50% and 90% of the reference rotational distance, between about 50% and 80% of the reference rotational distance, between about 60% and 90% of the reference rotational distance, between about 60% and 80% of the reference rotational distance, between about 60% and 70% of the reference rotational distance, between about 70% and 90% of the reference rotational distance, or between about 70% and 80% of the reference rotational distance. The base rotational distance imparted by the top drive 116 to the upper end 111 of the drill string 120 may instead be selected to be equal to the reference rotational distance. The base rotational distance imparted by the top drive 116 to the upper end 111 of the drill string 120 may instead be selected to be greater than the reference rotational distance. For example, the base rotational distance may be between about 100% and 125% of the reference rotational distance, between about 100% and 110% of the reference rotational distance, or between about 100% and 105% of the reference rotational distance.

After the reference rotational distance 433 and the base rotational distance are determined, the control system 200 may cause the top drive 116 to alternatingly rotate the upper end 111 of the drill string 120 in opposing directions based on the reference rotational distance 433 (i.e., by using the base rotational distance), and not based on the reference drill string torque (i.e., by using the reference or base drill string torque), to perform the subsequent slide drilling operations.

Figure 7:
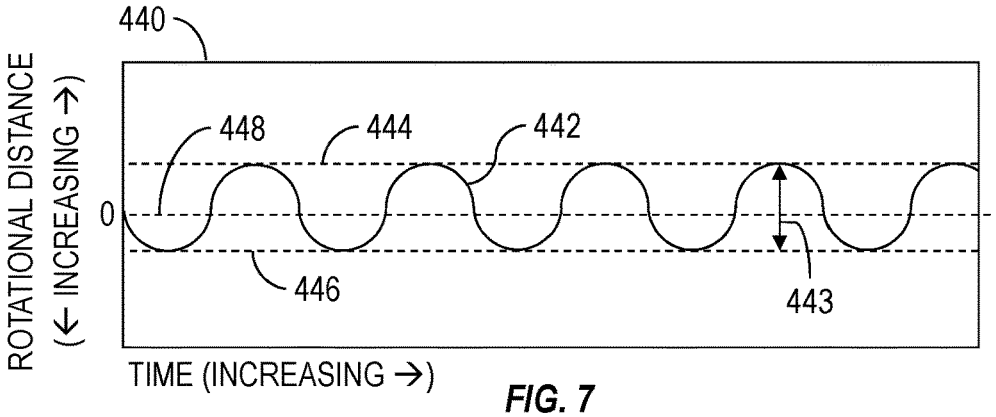

FIG. 7 is a graph 440 showing example rotational distance measurements 442 indicative of rotational distance of the drive shaft 118 of the top drive 116 through which the drive shaft 118 and thus the upper end 111 of the drill string 120 rotates in an alternating manner while performing the subsequent slide drilling operations based on the reference rotational distance 433 (i.e., by using the base rotational distance). The graph 440 may be generated by the control system 200 (e.g., the processing device 300 shown in FIG. 3 or one or more of the control devices 204 shown in FIG. 2). The graph 440 shows the rotational distance measurements 442, plotted along the vertical axis, with respect to time, plotted along the horizontal axis. The rotational distance measurements 442 may be output or otherwise facilitated by the rotation sensor 206 shown in FIG. 2. The control system 200 may receive and record the rotational distance measurements 442. The following description refers to FIGS. 1-7, collectively.

The rotational distance measurements 442 show the upper end 111 of the drill string 120 being rotated by the top drive 116 through a base rotational distance 443 that was determined based on the reference rotational distance 433, as described above. The rotational distance measurements 442 further show that the upper end 111 of the drill string 120 rotates alternatingly in opposing directions between a first rotational distance 444 in a first rotational direction and a second rotational distance 446 in a second rotational direction. The upward direction on the graph 440 may be the clockwise direction and the downward direction on the graph 440 may be the counterclockwise direction. The rotational distance may be measured with respect to an initial (i.e., zero) position 448 (e.g., an initial rotational position of the toolface 129). The rotational distance with respect to the initial position 448 may be slightly larger in the clockwise direction than in the counterclockwise direction.

During slide drilling operations, the control system 200 may cause the top drive 116 to stop each alternating rotation when the rotational distance measurements 442 indicate that the base rotational distance 443 (i.e., a predetermined fraction of the reference rotational distance 433) is reached. For example, the control system 200 may cause the top drive 116 to alternatingly rotate the upper end 111 of the drill string 120 in opposing directions based on the base rotational distance 443 to perform the slide drilling operations by causing the top drive 116 to alternatingly rotate the drill string 120 in opposing directions through the base rotational distance 443. This may include causing the drive shaft 118 of the top drive 116 to rotate in a first rotational direction from the initial rotational position 448 until the rotational distance measurements 432 indicate that the first rotational distance 444 is reached, and in a second rotational direction past the initial rotational position 448 until the rotational distance measurements 432 indicate that the second rotational distance 446 is reached.

The alternating rotations (i.e., rotational oscillations) through the base rotational distance 443 are configured to maintain a constant (i.e., the present) orientation of the toolface 129, which can be at the midpoint 448 of each rotational oscillation. Thus, the toolface 129 (the downhole orientation of the mud motor 128) is not expected to change unless there are changes to the midpoint 448 of the surface oscillations. For example, the base rotational distance 443 may be selected based on the reference rotational distance 433 such that the downhole toolface 129 is maintained substantially static or experiences rotational oscillations that are appreciably less than the base rotational distance, such as 0-15% (or some other predetermined percentage) of the base rotational distance.

The base rotational distance 443 may be changed (e.g., increased or decreased) depending on orientation of the downhole toolface 129. For example, if the orientation of the downhole toolface 129 changes more than an intended amount during slide drilling, such as if the toolface 129 oscillates by a few azimuthal degrees on either side of the intended orientation of the toolface 129, the control system 200 and/or a rig personnel (e.g., a driller) may decrease the base rotational distance 443 to a smaller fraction of the reference rotational distance 433. Furthermore, to steer the drill string 120 while slide drilling, the toolface 129 may be changed by altering one (or more) of the top drive rotations (i.e., oscillations) through the base rotational distance 443. For example, rotating the downhole toolface 129 in the clockwise direction may include increasing the base rotational distance 443 of one or more clockwise rotations and/or decreasing the base rotational distance 443 of one or more counterclockwise rotations. While slide drilling, the control system 200 and/or a rig personnel may also compensate for other drilling parameters. For example, the base rotational distance 443 may be modified depending on measured values of hook load and/or standpipe pressure (e.g., relative to an off-bottom reference).

In view of the entirety of the present disclosure, including the figures and the claims, a person having ordinary skill in the art will readily recognize that the present disclosure introduces an apparatus comprising a control system for controlling rotation of a top drive configured to connect with an upper end of a drill string, wherein the control system comprises: a torque sensor operable to facilitate torque measurements indicative of torque output by the top drive to the upper end of the drill string; a rotation sensor operable to facilitate rotational distance measurements indicative of rotational distance imparted by the top drive to the upper end of the drill string; and a processing device comprising a processor and a memory storing computer program code. The processing device is operable to: receive the torque measurements; receive the rotational distance measurements; cause the top drive to rotate the drill string while the drill string is off-bottom; determine a reference torque based on the torque measurements received while the drill string is off-bottom and rotated by the top drive; cause the top drive to alternatingly rotate the drill string in opposing directions based on the reference torque to perform slide drilling operations; determine a reference rotational distance based on the rotational distance measurements received during the slide drilling operations; and cause the top drive to alternatingly rotate the drill string in the opposing directions based on the reference rotational distance to perform the slide drilling operations.

The rotation sensor may be operable to facilitate rotational speed measurements indicative of rotational speed imparted by the top drive to the upper end of the drill string, and the processing device may be operable to cause the top drive to rotate the drill string while the drill string is off-bottom by causing the top drive to: increase the rotational speed until a predetermined rotational speed is reached; and maintain the predetermined rotational speed until the processing device determines the reference torque.

The processing device may be operable to: record the torque measurements while the drill string is off-bottom and rotated by the top drive; and determine the reference torque based on the recorded torque measurements, wherein the reference torque may be or comprise a maximum torque output by the top drive to the drill string.

The processing device may be operable to cause the top drive to alternatingly rotate the drill string in the opposing directions based on the reference torque to perform the slide drilling operations by causing the top drive to stop each alternating rotation when the torque measurements indicate that a predetermined fraction of the reference torque has been reached.

The processing device may be operable to cause the top drive to alternatingly rotate the drill string in the opposing directions based on the reference torque to perform the slide drilling operations by causing the top drive to rotate: in a first rotational direction from an initial rotational position until the torque measurements indicate that a first predetermined fraction of the reference torque has been reached; and in a second rotational direction from the initial rotational position until the torque measurements indicate that a second predetermined fraction of the reference torque has been reached.

The processing device may be operable to: record the rotational distance measurements during the slide drilling operations; and determine the reference rotational distance based on the recorded rotational distance measurements, wherein the reference rotational distance may be or comprise an average rotational distance of the alternating rotations of the drill string caused by the top drive.

The processing device may be operable to cause the top drive to alternatingly rotate the drill string in the opposing directions based on the reference rotational distance to perform the slide drilling operations by causing the top drive to stop each alternating rotation when the rotational distance measurements indicate that a predetermined fraction of the reference rotational distance has been reached.

The processing device may be operable to cause the top drive to alternatingly rotate the drill string in the opposing directions based on the reference rotational distance to perform the slide drilling operations by causing the top drive to alternatingly rotate the drill string in the opposing directions through a predetermined fraction of the reference rotational distance.

The present disclosure also introduces a method comprising commencing operation of a processing device operable to control rotation of a top drive configured to connect with an upper end of a drill string, wherein the operating processing device: receives torque measurements indicative of torque output by the top drive to the upper end of the drill string; receives rotational distance measurements indicative of rotational distance imparted by the top drive to the upper end of the drill string; causes the top drive to rotate the drill string while the drill string is off-bottom; determines a reference torque based on the torque measurements received while the drill string is off-bottom and rotated by the top drive; causes the top drive to alternatingly rotate the drill string in opposing directions based on the reference torque to perform slide drilling operations; determines a reference rotational distance based on the rotational distance measurements received during the slide drilling operations; and causes the top drive to alternatingly rotate the drill string in the opposing directions based on the reference rotational distance to perform the slide drilling operations.

The rotation sensor may be operable to facilitate rotational speed measurements indicative of rotational speed imparted by the top drive to the upper end of the drill string, and the processing device may cause the top drive to rotate the drill string while the drill string is off-bottom by causing the top drive to: increase the rotational speed until a predetermined rotational speed is reached; and maintain the predetermined rotational speed until the processing device determines the reference torque.

The processing device may: record the torque measurements while the drill string is off-bottom and rotated by the top drive; and determine the reference torque based on the recorded torque measurements, wherein the reference torque may be or comprise a maximum torque output by the top drive to the drill string.

The processing device may cause the top drive to alternatingly rotate the drill string in the opposing directions based on the reference torque to perform the slide drilling operations by causing the top drive to stop each alternating rotation when the torque measurements indicate that a predetermined fraction of the reference torque has been reached.

The processing device may cause the top drive to alternatingly rotate the drill string in the opposing directions based on the reference torque to perform the slide drilling operations by causing the top drive to rotate: in a first rotational direction from an initial rotational position until the torque measurements indicate that a first predetermined fraction of the reference torque has been reached; and in a second rotational direction from the initial rotational position until the torque measurements indicate that a second predetermined fraction of the reference torque has been reached.

The processing device may: record the rotational distance measurements during the slide drilling operations; and determine the reference rotational distance based on the recorded rotational distance measurements, wherein the reference rotational distance may be or comprise an average rotational distance of the alternating rotations of the drill string caused by the top drive.

The processing device may cause the top drive to alternatingly rotate the drill string in the opposing directions based on the reference rotational distance to perform the slide drilling operations by causing the top drive to stop each alternating rotation when the rotational distance measurements indicate that a predetermined fraction of the reference rotational distance has been reached.

The processing device may cause the top drive to alternatingly rotate the drill string in the opposing directions based on the reference rotational distance to perform the slide drilling operations by causing the top drive to alternatingly rotate the drill string in the opposing directions through a predetermined fraction of the reference rotational distance.

The present disclosure also introduces a method comprising commencing operation of a processing device operable to control rotation of a top drive configured to connect with an upper end of a drill string, wherein the operating processing device: receives torque measurements indicative of torque output by the top drive to the upper end of the drill string; receives rotational distance measurements indicative of rotational distance imparted by the top drive to the upper end of the drill string; causes the top drive to rotate the drill string while the drill string is off-bottom; determines a reference torque based on the torque measurements received while the drill string is off-bottom and rotated by the top drive; causes the top drive to alternatingly rotate the drill string in opposing directions based on the reference torque to perform a calibration stage of slide drilling operations; records the rotational distance measurements during the calibration stage of the slide drilling operations; determines a reference rotational distance based on the recorded rotational distance measurements, wherein the reference rotational distance is or comprises an average rotational distance of the alternating rotations of the drill string caused by the top drive; and causes the top drive to alternatingly rotate the drill string in the opposing directions based on the reference rotational distance to perform a post-calibration stage of the slide drilling operations.

The rotation sensor may be operable to facilitate rotational speed measurements indicative of rotational speed imparted by the top drive to the upper end of the drill string, and the processing device may cause the top drive to rotate the drill string while the drill string is off-bottom by causing the top drive to: increase the rotational speed until a predetermined rotational speed is reached; and maintain the predetermined rotational speed until the processing device determines the reference torque.

The processing device may: record the torque measurements while the drill string is off-bottom and rotated by the top drive; and determine the reference torque based on the recorded torque measurements, wherein the reference torque may be or comprise a maximum torque output by the top drive to the drill string.

The processing device may cause the top drive to alternatingly rotate the drill string in the opposing directions based on the reference torque to perform the slide drilling operations by causing the top drive to stop each alternating rotation when the torque measurements indicate that a predetermined fraction of the reference torque has been reached.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same functions and/or achieving the same benefits of the embodiments introduced herein. A person having ordinary skill in the art should also realize that such equivalent constructions do not depart from the scope of the present disclosure, and that they may make various changes, substitutions and alterations herein without departing from the spirit and scope of the present disclosure.

The Abstract at the end of this disclosure is provided to comply with 37 C.F.R. § 1.72(b) to permit the reader to quickly ascertain the nature of the technical disclosure. It is submitted with the understanding that it will not be used to interpret or limit the scope or meaning of the claims.

What is claimed is:

1. An apparatus comprising:

a control system for controlling rotation of a top drive configured to connect with an upper end of a drill string, wherein the control system comprises:

a torque sensor operable to facilitate torque measurements indicative of torque output by the top drive to the upper end of the drill string;

a rotation sensor operable to facilitate rotational distance measurements indicative of rotational distance imparted by the top drive to the upper end of the drill string, wherein the rotation sensor is further operable to facilitate rotational speed measurements indicative of rotational speed imparted by the top drive to the upper end of the drill string: and a processing device comprising a processor and a memory storing computer program code, wherein the processing device is operable to:

receive the torque measurements;

receive the rotational distance measurements;

cause the top drive to rotate the drill string while the drill string is off-bottom by causing the top drive to increase the rotational speed until a predetermined rotational speed is reached and maintain the predetermined rotational speed until the processing device determines a reference torque based on the torque measurements received while the drill string is off-bottom and rotated by the top drive, wherein the reference torque is or comprises a maximum torque output by the top drive to the drill string sufficient to rotate the drill string from the top drive to a lower end of the drill string;

cause the top drive to alternatingly rotate the drill string in opposing directions with respective first and second torques based on the reference torque to perform slide drilling operations, wherein the first and second torques are less than the reference torque;

determine a reference rotational distance based on the rotational distance measurements received during the slide drilling operations; and cause the top drive to alternatingly rotate the drill string in the opposing directions based on the reference rotational distance to perform the slide drilling operations.

2. The apparatus of claim 1, wherein the processing device is operable to:

record the torque measurements while the drill string is off-bottom and rotated by the top drive; and determine the reference torque based on the recorded torque measurements.

3. The apparatus of claim 1, wherein the processing device is operable to cause the top drive to alternatingly rotate the drill string in the opposing directions with the respective first and second torques based on the reference torque to perform the slide drilling operations by causing the top drive to stop each alternating rotation when the torque measurements indicate that a predetermined fraction of the reference torque is reached.

4. The apparatus of claim 1, wherein the processing device is operable to cause the top drive to alternatingly rotate the drill string in the opposing directions based on the reference torque to perform the slide drilling operations by causing the top drive to rotate:

in a first rotational direction from an initial rotational position until the torque measurements indicate that a first predetermined fraction of the reference torque is reached; and in a second rotational direction from the initial rotational position until the torque measurements indicate that a second predetermined fraction of the reference torque is reached, wherein the first rotational direction is opposite from the second rotational direction, and wherein the first predetermined fraction of the reference torque is different than the second predetermined fraction of the reference torque.

5. The apparatus of claim 1, wherein the first and second torques are different from one another.

6. The apparatus of claim 1, wherein the processing device is operable to cause the top drive to alternatingly rotate the drill string in the opposing directions based on the reference rotational distance to perform the slide drilling operations by causing the top drive to stop each alternating rotation when the rotational distance measurements indicate that a predetermined fraction of the reference rotational distance is reached.

7. The apparatus of claim 1, wherein the processing device is operable to cause the top drive to alternatingly rotate the drill string in the opposing directions based on the reference rotational distance to perform the slide drilling operations by causing the top drive to alternatingly rotate the drill string in the opposing directions through a predetermined fraction of the reference rotational distance.

8. A method comprising:

commencing operation of a processing device operable to control rotation of a top drive configured to connect with an upper end of a drill string and to receive rotational speed measurements from a rotation sensor, wherein the rotational speed measurements are indicative of rotational speed imparted by the top drive to the upper end of the drill string, and wherein the operating processing device:

receives torque measurements indicative of torque output by the top drive to the upper end of the drill string;

receives rotational distance measurements indicative of rotational distance imparted by the top drive to the upper end of the drill string;

causes the top drive to rotate the drill string while the drill string is off-bottom by causing the top drive to increase the rotational speed until a predetermined rotational speed is reached and maintain the predetermined rotational speed until the processing device determines a reference torque based on the torque measurements received while the drill string is off-bottom and rotated by the top drive, wherein the reference torque is or comprises a maximum torque output by the top drive to the drill string sufficient to rotate the drill string from the top drive to a lower end of the drill string;

causes the top drive to alternatingly rotate the drill string in opposing directions with respective first and second torques based on the reference torque to perform slide drilling operations, wherein the first and second torques are less than the reference torque;

determines a reference rotational distance based on the rotational distance measurements received during the slide drilling operations; and causes the top drive to alternatingly rotate the drill string in the opposing directions based on the reference rotational distance to perform the slide drilling operations.

9. The method of claim 8, wherein the processing device:

also records the torque measurements while the drill string is off-bottom and rotated by the top drive; and determines the reference torque based on the recorded torque measurements.

10. The method of claim 8, wherein the processing device causes the top drive to alternatingly rotate the drill string in the opposing directions with the respective first and second torques based on the reference torque to perform the slide drilling operations by causing the top drive to stop each alternating rotation when the torque measurements indicate that a predetermined fraction of the reference torque is reached.

11. The method of claim 8, wherein the processing device causes the top drive to alternatingly rotate the drill string in the opposing directions with the respective first and second torques based on the reference torque to perform the slide drilling operations by causing the top drive to rotate:

in a first rotational direction from an initial rotational position until the torque measurements indicate that a first predetermined fraction of the reference torque is reached; and in a second rotational direction from the initial rotational position until the torque measurements indicate that a second predetermined fraction of the reference torque is reached, wherein the first rotational direction is opposite from the second rotational direction, and wherein the first predetermined fraction of the reference torque is different than the second predetermined fraction of the reference torque.

12. The method of claim 8, wherein the first and second torques are different from one another.

13. The method of claim 8, wherein the processing device causes the top drive to alternatingly rotate the drill string in the opposing directions based on the reference rotational distance to perform the slide drilling operations by causing the top drive to stop each alternating rotation when the rotational distance measurements indicate that a predetermined fraction of the reference rotational distance is reached.

14. The method of claim 8, wherein the processing device causes the top drive to alternatingly rotate the drill string in the opposing directions based on the reference rotational distance to perform the slide drilling operations by causing the top drive to alternatingly rotate the drill string in the opposing directions through a predetermined fraction of the reference rotational distance.

15. A method comprising:

commencing operation of a processing device operable to control rotation of a top drive configured to connect with an upper end of a drill string and to receive rotational speed measurements from a rotation sensor, wherein the rotational speed measurements are indicative of rotational speed imparted by the top drive to the upper end of the drill string, and wherein the operating processing device:

receives torque measurements indicative of torque output by the top drive to the upper end of the drill string;

receives rotational distance measurements indicative of rotational distance imparted by the top drive to the upper end of the drill string;

causes the top drive to rotate the drill string while the drill string is off-bottom by causing the top drive to increase the rotational speed until a predetermined rotational speed is reached and maintain the predetermined rotational speed until the processing device determines a reference torque based on the torque measurements received while the drill string is off-bottom and rotated by the top drive, wherein the reference torque is or comprises a maximum torque output by the top drive to the drill string sufficient to rotate the drill string from the top drive to a lower end of the drill string;

causes the top drive to alternatingly rotate the drill string in opposing directions with respective first and second torques based on the reference torque to perform a calibration stage of slide drilling operations, wherein the first and second torques are less than the reference torque;

records the rotational distance measurements during the calibration stage of the slide drilling operations;

determines a reference rotational distance based on the recorded rotational distance measurements, wherein the reference rotational distance is or comprises an average rotational distance of the alternating rotations of the drill string caused by the top drive; and causes the top drive to alternatingly rotate the drill string in the opposing directions based on the reference rotational distance to perform a post-calibration stage of the slide drilling operations.

16. The method of claim 15, wherein the processing device:

also records the torque measurements while the drill string is off-bottom and rotated by the top drive; and determines the reference torque based on the recorded torque measurements.

17. The method of claim 15, wherein the processing device causes the top drive to alternatingly rotate the drill string in the opposing directions with the respective first and second torques based on the reference torque to perform the slide drilling operations by causing the top drive to stop each alternating rotation when the torque measurements indicate that a predetermined fraction of the reference torque is reached, and the first and second torques are different from one another.

18. The apparatus of claim 1, wherein the processing device determines the reference torque while pumps are pumping drilling fluid through the drill string and wherein the pumping of the drilling fluid causes rotational operation of a mud motor of the drill string.

19. The apparatus of claim 18, wherein the rotational operation of the mud motor applies torque to a lower end of the drill string that is in an opposing direction to the torque applied by the top drive to the upper end of the drill string such that the processing device causes the top drive to alternatingly rotate the drill string differently in the opposing directions due to the torque applied to the lower end of the drill string by the rotational operation of the mud motor.

20. The apparatus of claim 1, wherein the processing device causes the top drive to alternatingly rotate the drill string in the opposing directions based on the reference rotational distance to perform the slide drilling operations by rotation of the drill string a clockwise rotational distance with respect to an initial position and by rotation of the drill string a counterclockwise rotational distance with respect to the initial position, wherein the clockwise rotational distance with respect to the initial position is greater than the counterclockwise direction with respect to the initial position.

21. An apparatus comprising:

a control system for controlling rotation of a top drive configured to connect with an upper end of a drill string, wherein the control system comprises:

a torque sensor operable to facilitate torque measurements indicative of torque output by the top drive to the upper end of the drill string;

a rotation sensor operable to facilitate rotational distance measurements indicative of rotational distance imparted by the top drive to the upper end of the drill string, wherein the rotation sensor is further operable to facilitate rotational speed measurements indicative of rotational speed imparted by the top drive to the upper end of the drill string: and a processing device comprising a processor and a memory storing computer program code, wherein the processing device is operable to:

receive the torque measurements;

receive the rotational distance measurements;

cause the top drive to rotate the drill string while the drill string is off-bottom by causing the top drive to increase the rotational speed until a predetermined rotational speed is reached and maintain the predetermined rotational speed until the processing device determines a reference torque based on the torque measurements received while the drill string is off-bottom and rotated by the top drive;

determine the reference torque while pumps are pumping drilling fluid through the drill string and wherein the pumping of the drilling fluid causes rotational operation of a mud motor of the drill string;

cause the top drive to alternatingly rotate the drill string in opposing directions based on the reference torque to perform slide drilling operations, wherein the rotational operation of the mud motor applies torque to a lower end of the drill string that is in an opposing direction to the torque applied by the top drive to the upper end of the drill string such that the processing device causes the top drive to alternatingly rotate the drill string differently in the opposing directions due to the torque applied to the lower end of the drill string by the rotational operation of the mud motor;

determine a reference rotational distance based on the rotational distance measurements received during the slide drilling operations; and cause the top drive to alternatingly rotate the drill string in the opposing directions based on the reference rotational distance to perform the slide drilling operations.

22. An apparatus comprising:

a control system for controlling rotation of a top drive configured to connect with an upper end of a drill string, wherein the control system comprises:

a torque sensor operable to facilitate torque measurements indicative of torque output by the top drive to the upper end of the drill string;

a rotation sensor operable to facilitate rotational distance measurements indicative of rotational distance imparted by the top drive to the upper end of the drill string, wherein the rotation sensor is further operable to facilitate rotational speed measurements indicative of rotational speed imparted by the top drive to the upper end of the drill string: and a processing device comprising a processor and a memory storing computer program code, wherein the processing device is operable to:

receive the torque measurements;

receive the rotational distance measurements;

cause the top drive to rotate the drill string while the drill string is off-bottom by causing the top drive to increase the rotational speed until a predetermined rotational speed is reached and maintain the predetermined rotational speed until the processing device determines a reference torque based on the torque measurements received while the drill string is off-bottom and rotated by the top drive;

cause the top drive to alternatingly rotate the drill string in opposing directions based on the reference torque to perform slide drilling operations;

determine a reference rotational distance based on the rotational distance measurements received during the slide drilling operations; and cause the top drive to alternatingly rotate the drill string in the opposing directions based on the reference rotational distance to perform the slide drilling operations by rotation of the drill string a clockwise rotational distance with respect to an initial position and by rotation of the drill string a counterclockwise rotational distance with respect to the initial position, wherein the clockwise rotational distance with respect to the initial position is greater than the counterclockwise direction with respect to the initial position.

* * * * *